US012649639B2

(12) United States Patent
Bartocci et al.

(10) Patent No.: US 12,649,639 B2
(45) Date of Patent: Jun. 9, 2026

(54) SYSTEM AND METHOD FOR BUILDING A ROLL OF MATERIAL

(71) Applicant: Kimberly-Clark Worldwide, Inc., Neenah, WI (US)

(72) Inventors: Paul L. Bartocci, New Milford, CT (US); Robert E. Krautkramer, Jr., Combined Locks, WI (US); Vivek Moreshwar Karandikar, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 162 days.

(21) Appl. No.: 18/547,347

(22) PCT Filed: Mar. 30, 2021

(86) PCT No.: PCT/US2021/024924
§ 371 (c)(1),
(2) Date: Aug. 22, 2023

(87) PCT Pub. No.: WO2022/211792
PCT Pub. Date: Oct. 6, 2022

(65) Prior Publication Data

US 2024/0140752 A1 May 2, 2024

(51) Int. Cl.
*B65H 23/198* (2006.01)

(52) U.S. Cl.
CPC . *B65H 23/198* (2013.01); *B65H 2301/41734* (2013.01); *B65H 2513/11* (2013.01); *B65H 2515/10* (2013.01); *B65H 2801/84* (2013.01)

(58) Field of Classification Search
CPC .. B65H 18/145; B65H 18/26; B65H 19/2253; B65H 19/2261; B65H 19/2269;
(Continued)

(56) References Cited

U.S. PATENT DOCUMENTS 3,937,410 A * 2/1976 Justus ..... B65H 18/20 242/541.5
4,742,968 A * 5/1988 Young, Jr. ..... B65H 18/26 242/542.3

(Continued)

FOREIGN PATENT DOCUMENTS

CA 739329 A 7/1966
GB 2087362 A 5/1982

OTHER PUBLICATIONS

PCT Search Report Corresponding to Application No. PCT/US2021/024924 on Jul. 13, 2021.

(Continued)

*Primary Examiner* — Victoria P Augustine
*Assistant Examiner* — Ermia E. Melika
(74) *Attorney, Agent, or Firm* — Dority & Manning, P.A.

(57) ABSTRACT

A web winding process is disclosed for controlling one or more characteristics of a web of material being wound into a roll. In one aspect, the system includes a weighing platform that weighs the roll of material as the roll of material is building. From this information, a basis weight characteristic of the web is determined. One or more parameters in the web making process can be controlled in order to ensure that the basis weight characteristic of the web of material stays within preset limits. In this manner, rolls of material can be produced having uniform characteristics and dimensional stability.

21 Claims, 4 Drawing Sheets

(58) Field of Classification Search
CPC ..... B65H 2511/14; B65H 2511/16; B65H 2515/10; B65H 2515/34; B65H 2553/00; B65H 26/08; B65H 26/06; B65H 2601/22; B65H 2801/84; B65H 23/198; B65H 2301/41734; B65H 2513/11; B65H 2408/235; B65H 59/38; B65H 2220/03
USPC ..... 242/413.3, 534, 541, 541.4, 542, 542.3, 242/542.4, 544, 547
See application file for complete search history.

(56) References Cited

U.S. PATENT DOCUMENTS 5,154,367 A * 10/1992 Beisswanger ..... B65H 19/2261 242/542.3
5,267,703 A 12/1993 Biagiotti
5,308,930 A 5/1994 Tokutu et al.
5,370,327 A 12/1994 Adamski
5,560,566 A 10/1996 Bagnato
5,611,500 A 3/1997 Smith
5,664,737 A * 9/1997 Johnson ..... B65H 19/2261 242/542.3
5,901,918 A * 5/1999 Klerelid ..... B65H 18/26 242/532.2
6,036,137 A 3/2000 Myren
6,325,323 B1 12/2001 Olsson
6,553,331 B2 4/2003 Sakagami
6,948,678 B2 9/2005 Acciari
7,344,104 B2 3/2008 Hada et al.
8,757,533 B2 * 6/2014 Baggot ..... B65H 19/267 242/554.6
2005/0097966 A1 * 5/2005 Sartain ..... B65H 26/00 73/818
2007/0075178 A1 * 4/2007 Hada ..... B65H 18/26 242/541.3
2009/0189008 A1 * 7/2009 Gustavsson ..... B65H 18/26 242/547
2016/0016745 A1 1/2016 Malmqvist et al.
2017/0327337 A1 * 11/2017 Bixler ..... B65H 26/04
2019/0023515 A1 1/2019 Bartolini
2021/0039908 A1 * 2/2021 Bertolucci ..... B65H 19/2269

OTHER PUBLICATIONS

Djokorayono et al., Design of belt conveyor weight scale using gamma radiation technique, Advanced Industrial Technology in Engineering and Physics, vol. 2088, Issue 1, 2019, https://doi.org/10.1063/1.5095300 (Abstract Only).

* cited by examiner

SYSTEM AND METHOD FOR BUILDING A ROLL OF MATERIAL

RELATED APPLICATIONS

The present application is the national stage entry of International Patent Application No. PCT/US2021/024924 having a filing date of Mar. 30, 2021, which is incorporated herein in its entirety by reference thereto.

BACKGROUND

In the manufacture of various types of tissue products such as facial tissue, bath tissue, paper towels and the like, the dried tissue web or sheet coming off of the tissue machine is initially wound into a parent roll and temporarily stored for further processing. Sometime thereafter, the parent roll is unwound and the sheet is converted into a final product form.

In winding the tissue web into a large parent roll, it is vital that the roll be wound in a manner which prevents major defects in the roll and which permits efficient conversion of the roll into the final product, whether it be boxes of facial tissue sheets, rolls of bath tissue, rolls of embossed paper towels, and the like. Ideally, the parent roll has an essentially cylindrical form, with a smooth cylindrical major surface and two smooth, flat, and parallel end surfaces. The cylindrical major surface and the end surfaces should be free of ripples, bumps, waviness, eccentricity, wrinkles, etc., or, in other words, the roll should be "dimensionally correct." Likewise, the form of the parent roll must be stable, so that it does not depart from its cylindrical shape during storage or routine handling, or, in other words, the parent roll should be "dimensionally stable." Defects can force entire parent rolls to be scrapped if they are rendered unsuitable for high speed conversion.

One method currently used for monitoring the production of tissue webs as the web is produced and wound into rolls is to monitor and determine the basis weight of the web during production. Maintaining a uniform basis weight not only maintains a product with uniform properties but also can prevent against waste. In many systems and processes, the basis weight is monitored using scanners. Scanners can provide periodic readings that are relatively accurate, especially when producing untreated webs of material. Although scanners have proved somewhat reliable, further improvements are still needed in monitoring and determining the basis weight of webs as they are formed. For instance, conventional scanners are not well suited to measuring the basis weight of tissue webs treated with various coating materials. The coating materials, for instance, can be applied to the tissue webs in order to increase softness, lower friction, or provide any other enhanced properties. Currently, more and more tissue products are being topically treated which has significantly interfered with the use of basis weight scanners.

In addition, a need also exists for a basis weight monitoring system that not only can monitor the basis weight of coated webs, but can also do so more efficiently than conventional scanners.

SUMMARY

In general, the present disclosure is directed to a method and system for determining the basis weight of a sheet material, such as a tissue web. In one aspect, the system of the present disclosure monitors the changes in weight of a roll of material, as the roll of material is being wound. The weight of the roll is then converted into a basis weight characteristic. In accordance with the present disclosure, the basis weight can be continuously monitored as the roll of material builds. If the basis weight characteristic is outside preset limits, the system of the present disclosure can also use controls for making adjustments on the fly while the roll of material continues to build.

For example, in one embodiment, the present disclosure is directed to a system for winding a web into a roll of material. The system includes a rotatable reel spool for receiving and winding a web. The system further includes a mounting device for receiving the reel spool. The reel spool is rotatably mounted on the mounting device. The mounting device is configured to permit the reel spool to move along a length of the mounting device as a roll of material on the reel spool grows in diameter. The mounting device is placed in operative association with at least one weighing device, such as a plurality of spaced apart weighing devices. The weighing devices are configured to weigh the roll of material on the reel spool as the roll of material builds in diameter.

In one aspect, the system can further include a controller in communication with the at least one weighing device. The controller, for instance, can be one or more programmable devices, such as microprocessors. The controller can receive information from the at least one weighing device and, based on the information received from the at least one weighing device, can be configured to determine a basis weight characteristic of the web being wound on the reel spool. In one aspect, the system of the present disclosure is designed to receive a web directly from a web making process, such as a tissue making process. In one aspect, the controller can be configured to control at least one parameter of the web making process for maintaining the basis weight within a preset limit. For example, if the web making process is a tissue making process, the controller can be configured to control the amount of fibers being fed into the process for controlling basis weight.

The controller can be configured to determine the basis weight of the web continuously or periodically. In one embodiment, for instance, the controller can be configured to determine a basis weight characteristic of the web at least every two minutes, such as at least every one minute. In one aspect, the controller can be configured to determine a basis weight profile as a roll of material is building. The basis weight profile can then be compared to other profiles comprised of stored data and, based on the comparison, make a predictive determination of basis weight of the web. Based on the predictive determination of basis weight, the controller can then change at least one parameter in the web making process. The parameter, for instance, can be the fiber flow rate into the process, the web speed, the fiber consistency, the flow rate of the fluid carrier for the fiber, the headbox pressure, the headbox flow rate, the drying speed, and/or the drying temperature.

In one aspect, the mounting device can be a pair of opposing rails. Each rail can be configured to receive an opposing hub of the reel spool. The at least one weighing device can be a load cell. In one particular embodiment, for instance, the system can include at least four load cells spaced apart in a rectangular configuration. For example, two load cells may be used to support one of the rails of the mounting device.

The system can further include a retaining member for mounting the reel spool on the mounting device as a roll of material is wound on the reel spool. The retaining member can comprise at least one pivoting arm that holds and then releases the reel spool once a roll of material has been completely wound. In order to build a roll of material on the reel spool, the system can include a driven reel drum that has an outer surface. The outer surface of the reel drum can be biased against a roll of material being wound on the reel spool.

The system can further include a reel dispensing device for engaging an empty reel spool and placing the reel spool in contact with a free edge of a moving web for initiating winding on the reel spool. The reel dispensing device can further be configured to release the reel spool with a partially wound roll onto the mounting device for further winding of the device. The reel dispensing device can comprise a pivoting member that includes a first position and a second position. In the first position, the pivoting member can engage an empty reel spool. In the second position, on the other hand, the pivoting member can place the reel spool in engagement with a rotating drive for initiating winding of the web.

The mounting device can include a fixed portion and a floating portion. The fixed portion can be designed to receive a reel spool from the reel dispensing device. The floating portion, on the other hand, can be in operative association with at least one weighing device and can be designed to receive the reel spool containing a partially wound roll as soon as the diameter of the roll reaches a certain set point.

The present disclosure is also directed to a method for producing a web of material in a web making process. The method includes winding a web of material on a reel spool to form a roll of material. During winding, a weight of the roll of material is monitored as the diameter of the roll of material increases. A basis weight characteristic of the web is determined from the weight of the roll of material, and more particularly from the change in weight of the roll in relation to the speed of the web being wound. The method further includes the step of adjusting at least one parameter in the web making process based on the determined basis weight characteristic in order to maintain the basis weight of the web within preset limits.

In one aspect, the method can further include the step of predicting a future basis weight of the web based upon the monitored basis weight characteristic. At least one parameter of the web making process can be adjusted based on the predicted basis weight for maintaining the basis weight within preset limits before the basis weight drifts outside of those limits.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
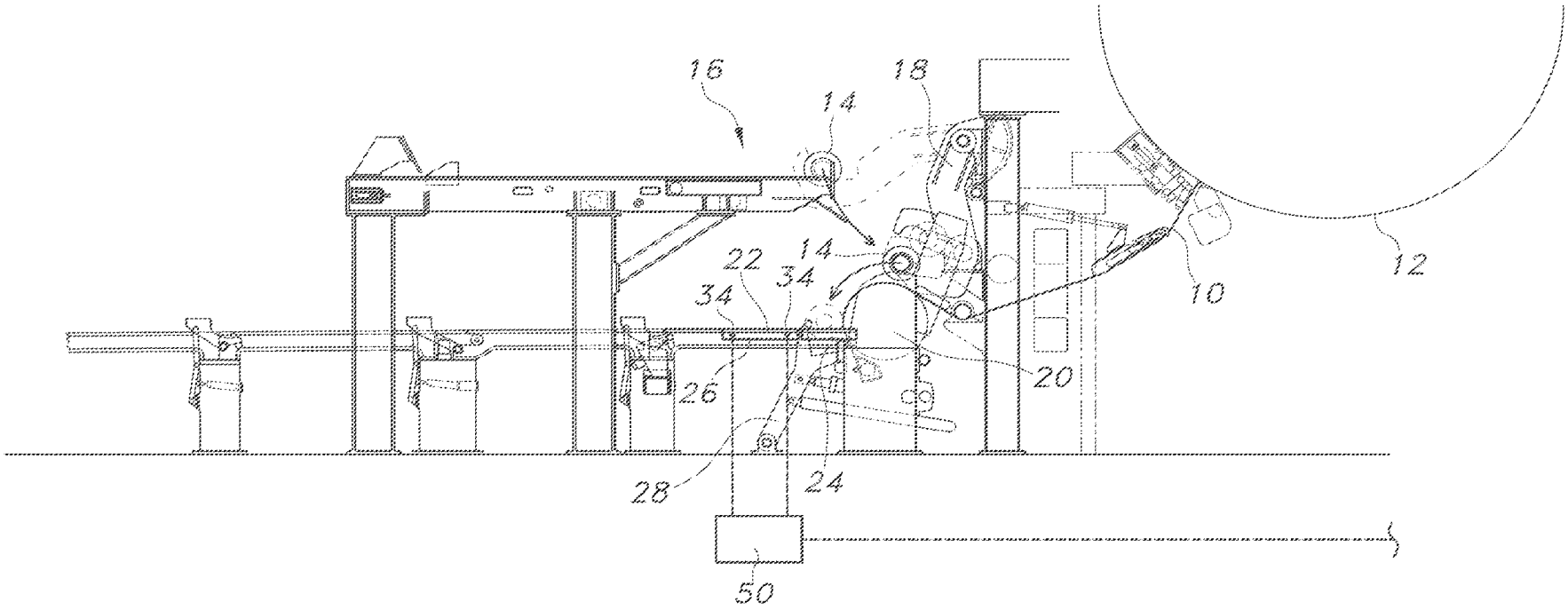
FIG. 1 is a side view of one embodiment of a winding system in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to a winding system for a web of material. In general, in one aspect, a web of material is wound on a reel spool that is supported on a platform that is capable of monitoring the changing weight of the roll as the roll of material is wound. The weight or change in weight of the roll of material can then be used to determine a basis weight characteristic. This information can be communicated to a control system capable of controlling at least one parameter in an upstream web making process. One or more parameters of the web making process can then be adjusted or controlled in order to maintain the basis weight of the web of material within preset limits. In one aspect, the system can be equipped with enhanced control that not only monitors and measures a basis weight characteristic of the web of material in real time but also is capable of predicting basis weight variations in the future. Based upon these predictions, the system can then proactively adjust one or more parameters in the web making process for producing rolls of materials with uniform characteristics.

Maintaining a uniform basis weight, for example, can result in products with better overall properties. Basis weight provides the papermaker with a way to measure and report the mass per unit area of a paper product. The basis weight may also be referred to in the art as "grammage," "ream weight," or "substance." The units of basis weight may vary but are commonly expressed as grams per square meter (gsm). Relatively light, low density paper products, such as tissue products, may have a basis weight of about 10 gsm or greater, such as from about 10 to about 100 gsm.

Figure 2:
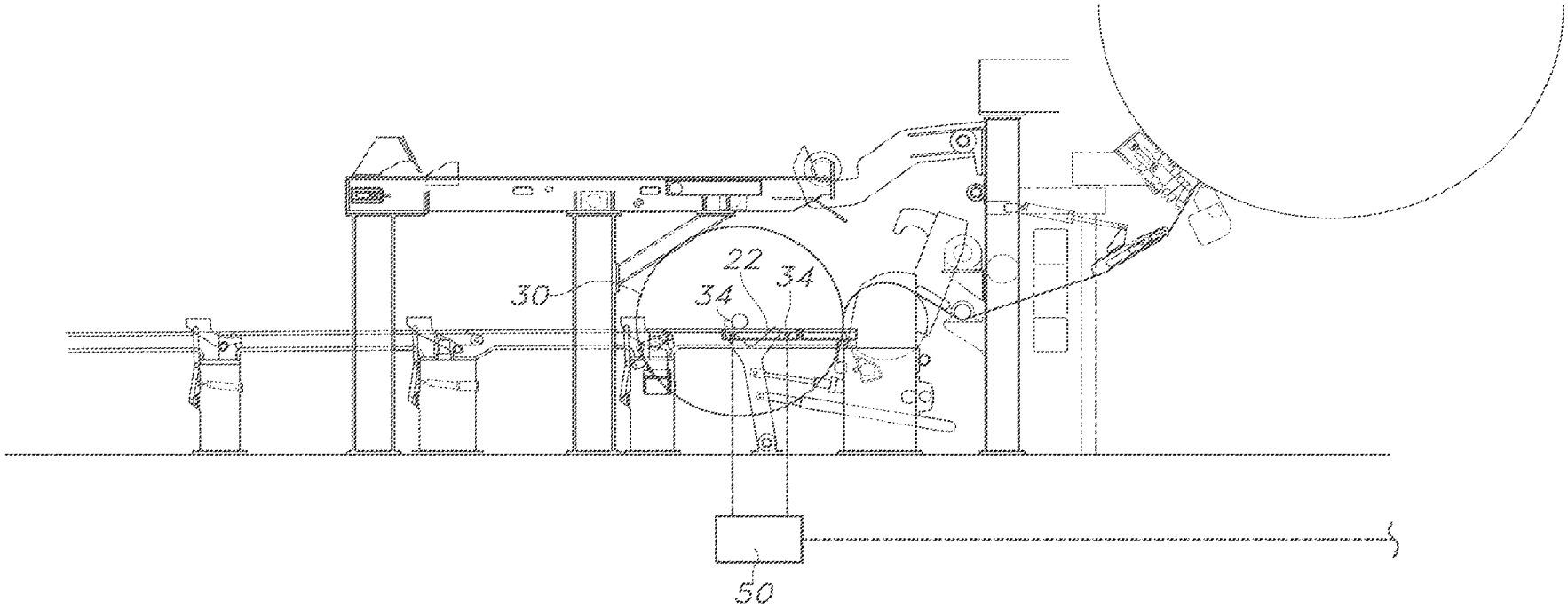
FIG. 2 is a side view of the winding system illustrated in FIG. 1.
Figure 3:
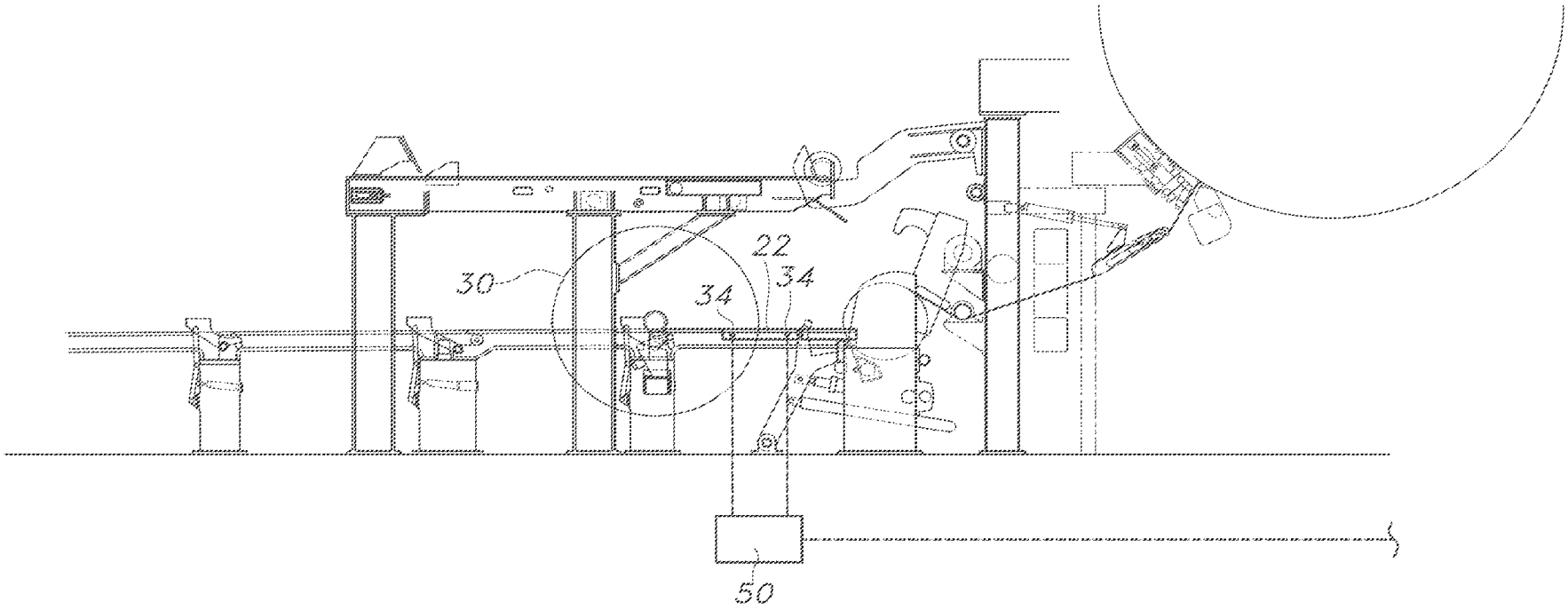
FIG. 3 is a side view of the winding system illustrated in FIG. 1.

Referring to FIGS. 1-3, for instance, one embodiment of a system made in accordance with the present disclosure is shown. Referring to FIG. 1, for instance, a web of material 10 is shown being formed from a web making process. The system and process of the present disclosure can be used in conjunction with any suitable web making process. In the embodiment illustrated in FIG. 1, the web of material 10 is intended to represent a tissue product that is coming off of a dryer drum 12. The tissue web 10, for instance, can contain primarily pulp fibers, such as softwood fibers, hardwood fibers, or mixtures thereof. The tissue web can also contain synthetic fibers generally in an amount up to about 10% by weight. The tissue web 10 can also contain various other components. For instance, the tissue web 10 can be topically treated with various different additives. Topical treatments include, for instance, a silicone composition, a polyolefin composition, an antiviral composition, a moisturizing composition, or the like. When producing tissue webs, the tissue web can have a bulk of from about 3 cc/g to about 14 cc/g, such as from about 5 cc/g to about 12 cc/g. The basis weight of the tissue web 10 can be from about 7 gsm to about 200 gsm, including all increments of 1 gsm therebetween. For instance, the target basis weight of the tissue web can be greater than about 10 gsm, such as greater than about 12 gsm, such as greater than about 15 gsm, such as greater than about 18 gsm, such as greater than about 20 gsm, and generally less than about 150 gsm, such as less than about 120 gsm, such as less than about 100 gsm, such as less than about 90 gsm, such as less than about 80 gsm. In particular embodiments, the basis weight of the tissue web can be from about 15 gsm to about 30 gsm, or from about 25 gsm to about 60 gsm, depending upon the type of product being produced. For example, the tissue web can be used to produce bath tissue, facial tissue, paper towels, industrial wipers, premoistened wipes, and the like.

When forming a tissue web, the upstream web making process can be an air-laid process or a wet-laid process. When producing tissue webs through a wet-laid process, a fiber furnish containing, for instance, pulp fibers, can be combined with water and fed to a headbox. From the headbox, the aqueous dispersion of fibers can flow onto a forming surface. The forming surface can be porous, allowing the carrier liquid or water to drain. The forming surface, for instance, can be a wire or a felt. From the forming surface, the web can be transferred to various different transfer fabrics before being placed through a dryer, such as a through-air drier or on the surface of the dryer drum 12 as shown in FIG. 1. The different transfer fabrics can be used to not only facilitate drying of the web and improving formation but also can be used to improve one or more properties of the web. For instance, the web can be fed from one transfer fabric to a downstream fabric at a speed differential that causes a rush transfer process to occur for increasing the bulk of the web. In addition, the web can be placed on a three-dimensional forming fabric and subjected to external pressure, such as a suction force, that causes the three-dimensional structure of the fabric to be imprinted on the tissue web. As described above, during the tissue making process, various different topical additives can be applied to the web.

In the embodiment illustrated in FIG. 1, the web of material 10 is being fed directly from an upstream web making process into the winding system of the present disclosure. Although the system in FIG. 1 can provide various benefits when it comes to controlling different parameters within the web making process, alternatively, the winding system of the present disclosure can be used to unwind a premade web of material from one roll and to wind the material into one or more different rolls. For instance, the system and process of the present disclosure can also be used to unwind a parent roll and form a plurality of smaller daughter rolls from the parent roll.

As shown in FIG. 1, the web of material 10, after being dried by the dryer drum 12, is fed to a reel spool 14 to initiate winding. In FIG. 1, the reel spool 14 is shown in an edge engagement position for engaging a free end of the web of material to initiate winding. The reel spool 14 is initially placed in association with a reel dispensing device 18. The reel dispensing device 18 is for engaging an empty reel spool and placing the reel spool in contact with the free edge of the moving web to begin the winding process. In the embodiment illustrated in FIG. 1, the reel dispensing device 18 comprises a pivoting member that pivots between a first position and a second position. In the first position, the reel dispensing device engages an empty reel spool 14 from a reel staging location 16. Once engaged with an empty reel spool 14, the reel dispensing device 18 then pivots to a second position as shown in FIG. 1. In the second position, the reel dispensing device 18 places the empty reel spool in engagement with a driven reel drum 20. A free edge of the web of material 10 is fed onto the reel drum 20 and around the reel spool 14 in order to begin the winding process.

Once winding has been initiated on the reel spool 14, the reel spool follows along the circumference of the reel drum 20 and drops onto a mounting device 22. The mounting device 22 is for permitting further winding of the web on the reel spool 14 while also weighing the roll of material as it builds in accordance with the present disclosure.

In one embodiment, the mounting device 22 can be divided into a fixed portion 24 and a floating portion 26. The fixed portion 24 is for receiving the reel spool 14 from the edge engaging position. The fixed portion 24, for instance, can be designed to absorb the impact of the falling reel spool 14. In other embodiments, however, the system can be designed to gradually place the reel spool onto the mounting device 22 for eliminating the fixed portion 24.

As the reel spool 14 drops onto the mounting device 22, the reel spool 14 is engaged by a retaining member 28. The retaining member 28 biases the reel spool 14 against the reel drum 20 for continued winding of the web of material 10.

As shown in FIGS. 1-3, the retaining member 28 can include at least one pivoting arm that permits the reel spool to move along the length of the mounting device 22 as the roll of material on the reel spool grows in diameter. As shown in FIG. 3, once a roll of material 30 reaches a desired diameter, the reel spool 14 moves out of engagement with the retaining member 28 and rolls off the mounting device 22. During this process, the web of material 10 is cut to produce a free edge that then engages a new reel spool 14 positioned on the reel dispensing device 18.

The system and process of the present disclosure are particularly designed to monitor a basis weight characteristic of the web of material 10 as a roll of material 30 is being formed. In this regard, the mounting device 22 is placed in communication with at least one weighing device. More particularly, as shown in FIGS. 1-3 and in FIG. 4, the mounting device 22 can comprise any suitable platform and, in one embodiment, can comprise a pair of opposing rails, such as rail 32 that is designed to support opposing ends of the reel spool 14. In FIGS. 1-4, for instance, only a single rail 32 is shown. The mounting device 22, however, can include a second parallel rail that can support the opposite end of the reel spool 14.

In accordance with the present disclosure, the opposing rails 32 can be floating rails that contain weighing devices such as one or more load cells 34. The number and amount of load cells 34 can vary depending upon the particular application. In the embodiment illustrated in FIGS. 1-4, each rail 32 is equipped with two load cells 34. In essence, the rails float on the load cells for measuring the weight of the roll of material 30. Consequently, in the embodiment shown, the mounting device 22 includes four different load cells 34 that are spaced apart in a rectangular configuration. The mounting device, however, can operate with a single load cell, with two load cells, with more than two load cells, with more than four load cells, with more than six load cells, and generally less, in one embodiment, than about twenty load cells, such as less than about ten load cells, such as less than about eight load cells.

Figure 4:
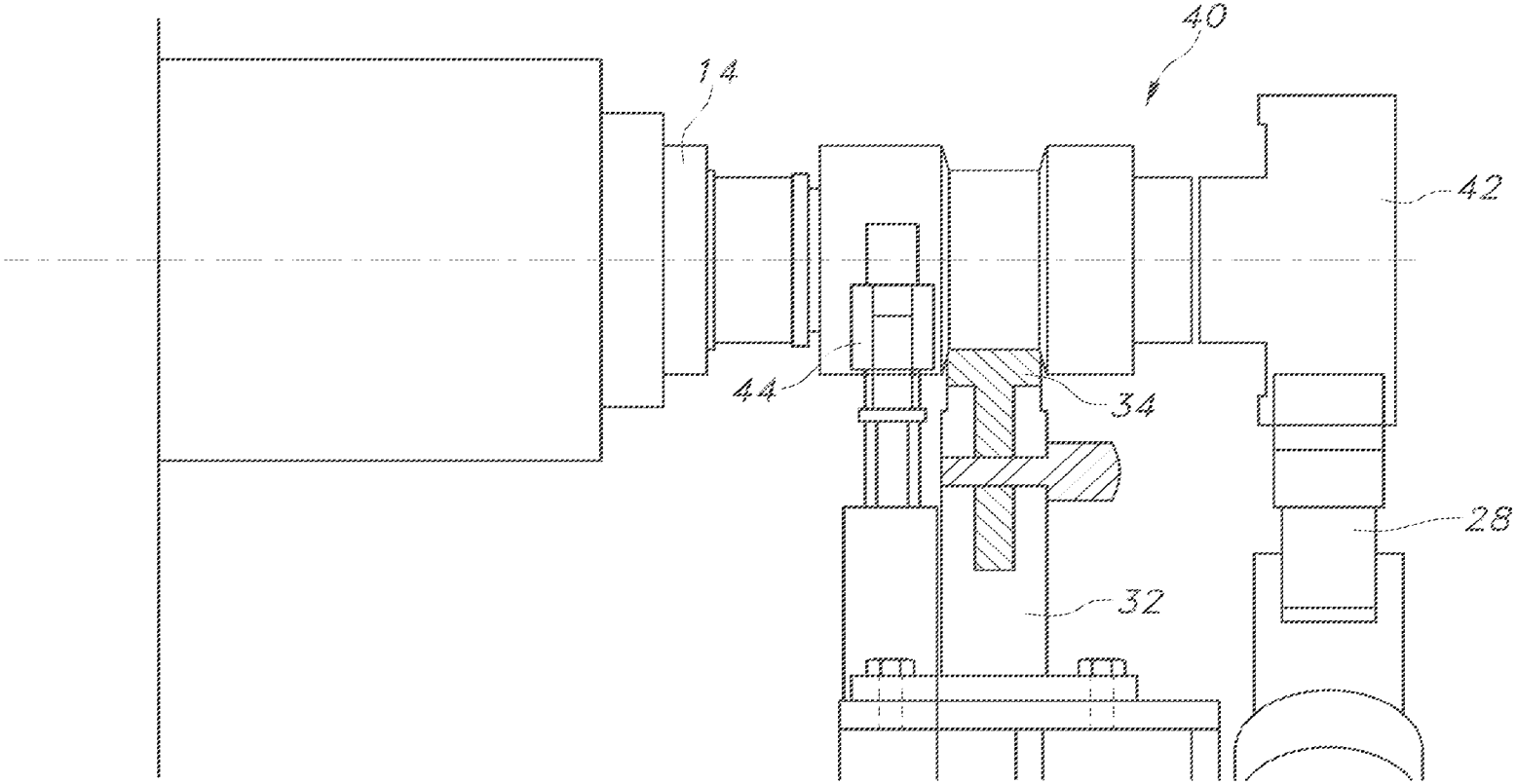
FIG. 4 is a side view of a mounting device in accordance with the present disclosure shown engaging an end portion of a reel spool upon which a roll of material is wound.

Referring to FIG. 4, an enlarged view is shown of an end 40 of a reel spool 14 being supported by a rail 32 of the mounting device 22. As shown, the rail 32 is in operative association with the load cell 34. In this embodiment, the end 40 of the reel spool 14 also includes a hub 42 that is shown in engagement with the retaining member 28. The system can optionally include a rotational sensor 44 for monitoring the rotational speed of the reel spool 14 during winding.

The load cell 34 is designed to monitor the weight of the roll of material 30 as the material is building. As shown in the drawings, multiple load cells can be used in order to increase accuracy and precision. For instance, the load cells 34 can be designed to take measurements depending upon the location of the reel spool 14. Alternatively, each of the load cells 34 can operate in tandem and the results can be averaged to produce a single data point regarding the weight of the roll of material 30.

The load cells 34, as shown in FIGS. 1-3, can be placed in communication with a controller 50. The controller 50 can be any suitable programmable device and may comprise one or more microprocessors. The controller 50 is configured to receive information from each of the load cells and determine or calculate a basis weight characteristic of the web of material 10. For example, the controller can determine a basis weight characteristic based upon the weight measurement in conjunction with linear length and width of the web of material 10. In addition, the controller can be in communication with a sensor that monitors the rotational speed of the reel spool 14, the speed of the reel drum 20, or the speed of the web of material 10 that is being fed into the winding operation. From this information, the controller 50 can be configured to determine a basis weight characteristic, which may be a parameter related to basis weight or can be a determination of the basis weight itself.

In one aspect, the controller 50 can be configured to determine the rate of change of weight of the roll of material as the roll builds in units of weight per time. The rate of change of weight can then be divided by the rate of the web movement in units of area per time to arrive at the basis weight characteristic. The rate of movement of the web in area per time units can be calculated from monitoring the speed of the web and measuring the width of the web. All of the above information can be used together to ensure that not only does the web of material remain uniform but that the characteristics of the roll of material remain uniform with dimensional stability.

As shown in FIG. 1, the controller 50 can also be placed in communication with the web making process for controlling one or more parameters within the web making process.

For example, in one aspect, the controller can receive information from the winding system including information from the one or more load cells 34 and determine a basis weight characteristic of the web of material 10, which may include the differential weight gain of the roll of material 30. Based upon the determined basis weight characteristic, the controller can then be configured to control at least one parameter of the web making process for maintaining the basis weight of the web within preset limits. For example, in one embodiment, the controller can be configured to control the amount of fibers being fed into the web making process, especially when the web making process is producing tissue webs. Instead of or in addition to the fiber flow rate of the web making process, the controller can also be configured to control web speed, a fiber consistency within the process, a flow of a fluid carrier for fibers in the process, a headbox pressure, a headbox flow rate, a dryer speed, a dryer temperature, or combinations thereof in order to maintain the basis weight of the web within preset limits. The preset limits can allow for a certain amount of variation depending upon the particular product. For instance, the preset limits may allow for a variation in basis weight of up to about 15%, such as up to about 10%, such as up to about 8%, such as up to about 5%, such as up to about 3%. In certain embodiments, the process and system of the present disclosure can be used to control basis weight such that the basis weight does not vary by more than about 5%, such as by no more than about 3%, such as by no more than about 2%, such as by no more than about 1%.

Especially in comparison to winding processes in the past, the system and process of the present disclosure is capable of making determinations regarding a basis weight characteristic very quickly or even continuously. In one aspect, for instance, the controller can be configured to determine a basis weight characteristic of the web of material 10 on the reel spool at least every 2 minutes, such as at least every 1.5 minutes, such as at least every 1 minute, such as at least every 0.5 minutes, such as at least every 0.25 minutes, such as at least every 0.1 minute, such as at least every 0.05 minutes, such as at least every 0.01 minute. The system and process of the present disclosure, for instance, can be used to determine a basis weight characteristic at intervals less than about 10 seconds, such as less than about 8 seconds, such as less than about 5 seconds, such as less than about 3 seconds, such as even less than about 1 second.

In one particular aspect, the controller 50 can be further configured to determine a basis weight profile of the web of material 10 as the roll of material 30 is building. The controller, for instance, may contain stored data from past web making and winding processes in which certain variables have been varied. This reference data can then be compared to the basis weight profile and, based on the comparison, the controller 50 can be configured to make a predictive determination of a basis weight characteristic of the web. In this manner, the controller can be configured to change at least one parameter of the tissue making process based upon the predictive determination of the basis weight characteristic.

The stored reference data used by the controller 50 can be based on many different past processes in which many different variables in the web making process were varied to determine their impact upon basis weight or otherwise their impact on web uniformity. Such parameters of the web making process can include a creping ratio, machine speed, a reel speed, a transfer vacuum force, web consistency at any point in the process including web consistency on the forming fabric, web consistency on a transfer fabric, or web consistency on a drying fabric. Other parameters include stock flow rates, dryer speed, dryer temperature, dryer fin pump speed, dryer pressure, dryer air flow if the dryer is a through-air dryer, felt flow rates, headbox pressure, defoamer amount, fiber refiner amount, secondary screen flow rates, tray chest levels, clarifier supply flow rate, fabric turning roll speed, showerhead pressures, web tension, forming roll speed, pickup shoe vacuum amounts, pressure roll vacuum amounts, box vacuum control, box water flow rates, and the like.

One or more of these parameters can be controlled in the web making process in order to maintain the basis weight of the web of material 10 within carefully controlled tolerances.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A system for winding a web into a roll comprising:

a rotatable reel spool for receiving and winding the web;

a mounting device for receiving the reel spool, the reel spool being rotatably mounted on the mounting device, the mounting device being configured to permit the reel spool to move along a length of the mounting device as a roll of material on the reel spool grows in diameter;

at least one weighing device in operative association with the mounting device, the at least one weighing device being configured to weigh the roll of material on the reel spool as the roll of material builds in diameter, wherein the at least one weighing device includes at least two four load cells spaced apart in a rectangular configuration; and a controller in communication with the at least one weighing device, wherein, based on information received from the at least one weighing device, the controller is configured to determine a basis weight characteristic of the web being wound on the reel spool.

2. A system as defined in claim 1, wherein the mounting device comprises a pair of opposing rails, the opposing rails being positioned in a parallel relationship along the length of the mounting device, each rail being configured to receive an opposing hub of the reel spool.

3. A system as defined in claim 2, wherein the opposing rails each contain at least one load cell.

4. A system as defined in claim 1, wherein the system includes at least six load cells spaced apart in a rectangular configuration.

5. A system as defined in claim 1, wherein the mounting device is supported on the at least two load cells.

6. A system as defined in claim 1, further comprising a retaining member for maintaining the reel spool on the mounting device as the roll of material is wound on the reel spool.

7. A system as defined in claim 6, wherein the retaining member comprises at least one pivoting arm that holds the reel spool as the roll of material increases in diameter and then releases the reel spool once the roll of material has been completely wound.

8. A system as defined in claim 1, further comprising a driven reel drum having an outer surface, the outer surface being biased against the roll of material being wound on the reel spool, the reel drum being rotated for causing the web of material to wind on the reel spool.

9. A system as defined in claim 1, further comprising a reel dispensing device for engaging an empty reel spool and placing the reel spool in contact with a free edge of a moving web for initiating winding on the reel spool, the reel dispensing device further being configured to release the reel spool with a partially wound roll of the web onto the mounting device for further winding of the reel spool.

10. A system as defined in claim 9, wherein the reel dispensing device comprises a pivoting member that includes a first position and a second position, wherein, when in the first position, the pivoting member engages the empty reel spool and, when in the second position, places the empty reel spool in engagement with a rotating drum for initiating winding of a web onto the reel spool.

11. A system as defined in claim 9, wherein the mounting device includes a fixed portion and a floating portion, the fixed portion being positioned to receive the reel spool from the reel dispensing device, the floating portion being in operative engagement with the at least one weighing device.

12. A system as defined in claim 1, wherein the system is configured to receive the web directly from a web making process, wherein the controller, based upon basis weight characteristic determinations of the web, is configured to control at least one parameter of the web making process for maintaining the basis weight of the web within preset limits.

13. A system as defined in claim 8, wherein the reel drum is positioned to receive the web directly from a dryer from a tissue making process.

14. A system as defined in claim 1, wherein the controller comprises one or more microprocessors.

15. A system as defined in claim 13, wherein the web making process comprises the tissue making process and wherein the controller is configured to control an amount of fibers being fed into the process.

16. A system as defined in claim 1, wherein the controller is configured to determine a basis weight characteristic of the web of material on the reel spool at least every two minutes.

17. A system as defined in claim 15, wherein the controller is further configured to determine a basis weight profile of the web as the roll of material is building, the controller comparing the basis weight profile to stored data and, based on the comparison, is configured to make a predictive determination of a basis weight characteristic of the web.

18. A system as defined in claim 17, wherein the controller is configured to change at least one parameter of the tissue making process based upon the predictive determination of the basis weight characteristic, wherein the at least one parameter of the tissue making process comprises a fiber flow rate into the process, a web speed, a fiber consistency within the process, a flow of a fluid carrier for fibers in the process, a headbox pressure, a headbox flow rate, a dryer speed, a dryer temperature, or combinations thereof.

19. A method for controlling a basis weight of a web of material comprising:

producing the web of material in a web making process;

winding the web of material on a reel spool to form a roll of material;

monitoring a weight of the roll of material as a diameter of the roll increases;

determining a basis weight characteristic of the web of material from the weight of the roll of material; and adjusting at least one parameter in the web making process based on the determined basis weight characteristic in order to maintain a basis weight of the web of material within preset limits, wherein the at least one parameter that is adjusted comprises an amount of fibers fed into the web making process.

20. A method as defined in claim 19, wherein the web making process comprises a tissue making process in which a tissue web is produced from an aqueous suspension of fibers.

21. A method as defined in claim 19, further comprising the steps of comparing changes in the basis weight characteristic of the web of material as the roll of material is building to reference data in order to produce a predictive determination of basis weight and adjusting at least one parameter in the web making process based on the predictive determination of basis weight.

* * * * *